US005855807A

United States Patent [19]

Hsieh

[11] Patent Number: 5,855,807

[45] Date of Patent: Jan. 5, 1999

[54] CONCRETE FORM SECURING DEVICE

[76] Inventor: Ming-Huei Hsieh, P.O. Box 90, Tainan 704, Taiwan

[21] Appl. No.: 668,935

[22] Filed: Jun. 24, 1996

[51] Int. Cl.[6] ..... E04G 11/08; E04G 17/06

[52] U.S. Cl. ..... 249/43; 249/44; 249/45; 249/46; 249/47; 249/193; 249/219.1

[58] Field of Search ..... 249/40, 43, 45, 249/46, 44, 193, 192, 219.1, 47

[56] References Cited

U.S. PATENT DOCUMENTS

| | | | |
|---|---|---|---|
| 1,315,027 | 9/1919 | McKay | 249/193 |
| 2,020,515 | 11/1935 | Newton | 249/46 |
| 3,086,272 | 4/1963 | Ruth et al. | 249/45 |
| 3,486,729 | 12/1969 | Schimmel | 249/45 |
| 4,473,209 | 9/1984 | Gallis et al. | 249/45 |
| 5,375,810 | 12/1994 | Mathis | 249/44 |
| 5,552,103 | 9/1996 | Lee | 249/193 |
| 5,620,628 | 4/1997 | Ritchie | 249/193 |

*Primary Examiner*—Khanh P. Nguyen

[57] ABSTRACT

A concrete form securing device includes two or more securing frames combined together, plural spacing bars, plural engaging members, and plural fixing boards as main components. The two securing frames are temporarily kept in place by a sustain bar and two or more annular clampers and then combined with the horizontal fixing boards and secured by the engaging members, the support boards, the cushion members, and the engaging members, and a pair of two securing frames are kept spaced apart by the spacing bars so as to form a space between two rows of the securing frames, and a concrete wall may be formed in the space, after the sustain bars and the annular clampers are removed.

3 Claims, 7 Drawing Sheets

CONCRETE FORM SECURING DEVICE

BACKGROUND OF THE INVENTION

This invention concerns a concrete form securing device, particularly able to be assembled detachably together, without utilizing any holes bored in concrete forms or bolts and nuts for securing concrete forms, with concrete forms almost not impaired or harmed in building process and in assembling and disassembling, and saving time and cost as well.

The most common conventional concrete form securing device shown in FIG. 1 includes plural threaded rods 10 having an intermediate portion wrapped with a rubber layer 11 and screwed tightly with a nut 12 respectively at two ends thereof. Then each threaded rod 10 is fitted through two opposite concrete forms 1, 1 and through two support rods 13 tightly held by the nuts 12 to keep the two concrete forms 1, 1 securely in place. After concrete is filled and hardens in the space between a pair of two concrete forms 1, 1, the nuts 12 are loosenend, and then the threaded rods 10 may be pulled out of the hardened concrete, as they have the rubber layer 11 on the intermediate portion. Then the concrete forms 1, 1 may be taken off. In addition, the holes left in the hardened concrete wall by the threaded rods 1, 1 are to be filled.

However, the known conventional concrete form securing device described above necessitates concrete forms to be bored holes for the threaded rods to pass through so as to position or take them off, and nuts 12 have to be screwed tight or loosened every time when concrete forms are to be used in building a wall. And such work needs much labor and cost, and impair and harm may happen to the concrete forms, adding extra cost.

SUMMARY OF THE INVENTION

This invention has been devised to offer a kind of concrete form securing device able to be speedily assembled and detached.

A main feature of the present invention is a position side wall respectively formed to extend sidewise from two sides of a bottom of a frame body of a securing frame for two vertical ends of a concrete form to rest securely.

Another feature of the present invention is plural insert blocks, which are located inside the frame body, having an insert groove for an engage member to engage therein and a bar hole for an end of each spacing bar to pass through so as to secure the spacing bar with a horizontal fixing board and a cushion member with a flat pin inserting in a pin hole of each end of the spacing bar. Then the spacing bar may be secured between a pair of two securing frames, with the concrete forms fixed between the two securing frames, forming a space between the pair of two concrete forms, into which concrete may be poured in to build a wall.

BRIEF DESCRIPTION OF DRAWINGS

This invention will be better understood by reference to the accompanying drawings, wherein.

DESCRIPTION OF THE PREFERRED EMBODIMENT

Figure 1:
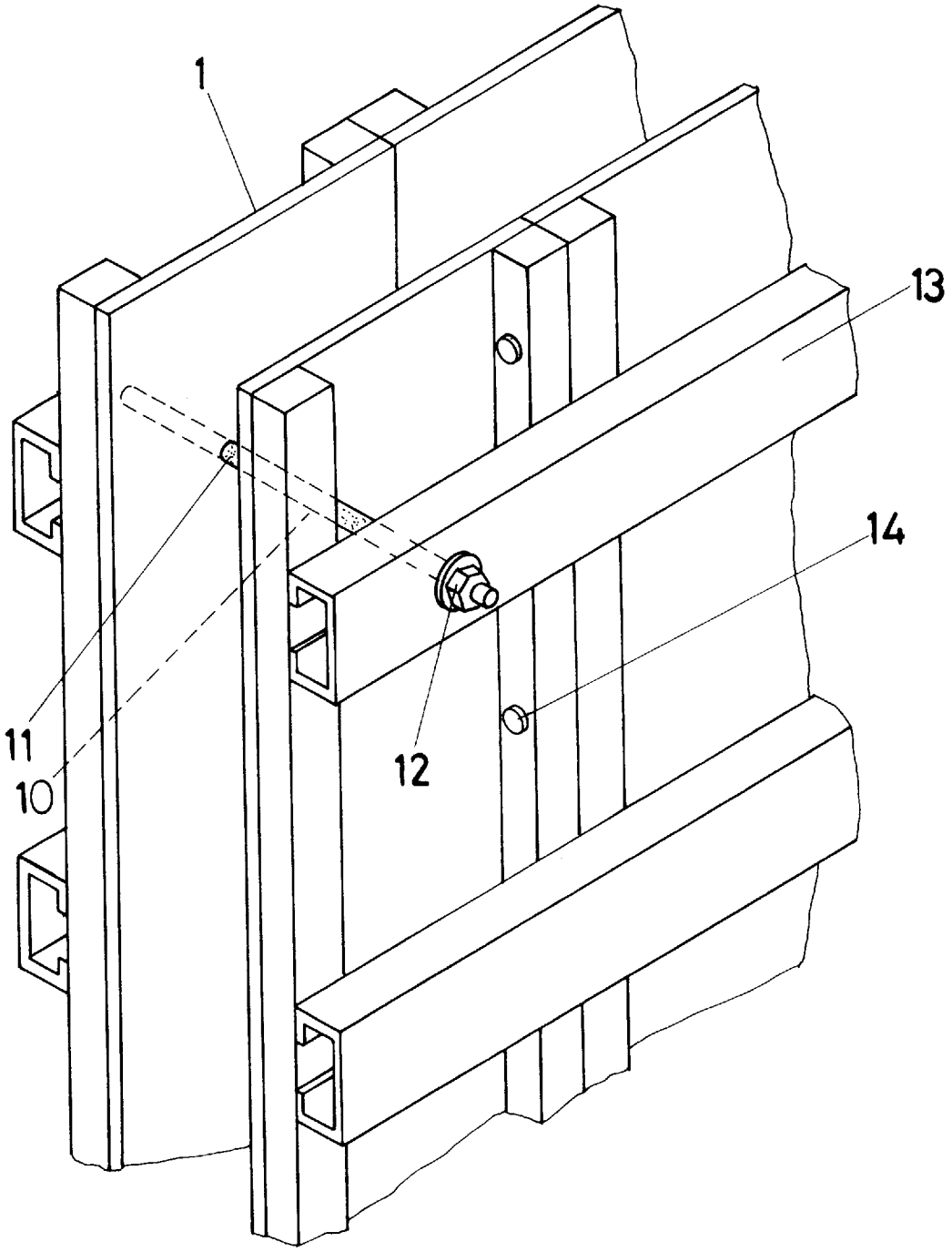
FIG.1 (PRIOR ART)
FIG. 1 is a perspective view of a known conventional concrete form securing device.
Figure 2:
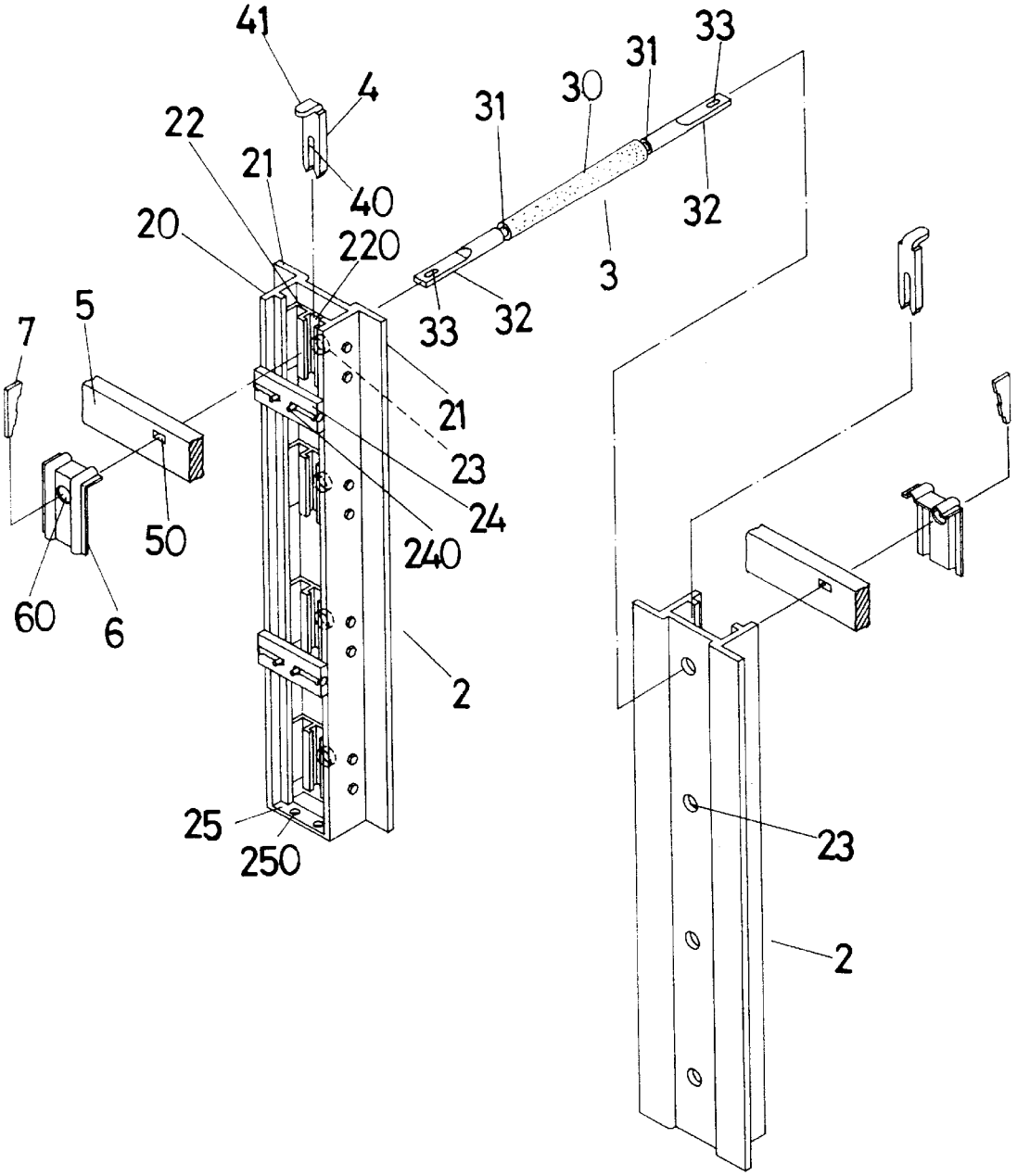
FIG. 2 is an exploded perspective view of a concrete form securing device in the present invention.
Figure 3:
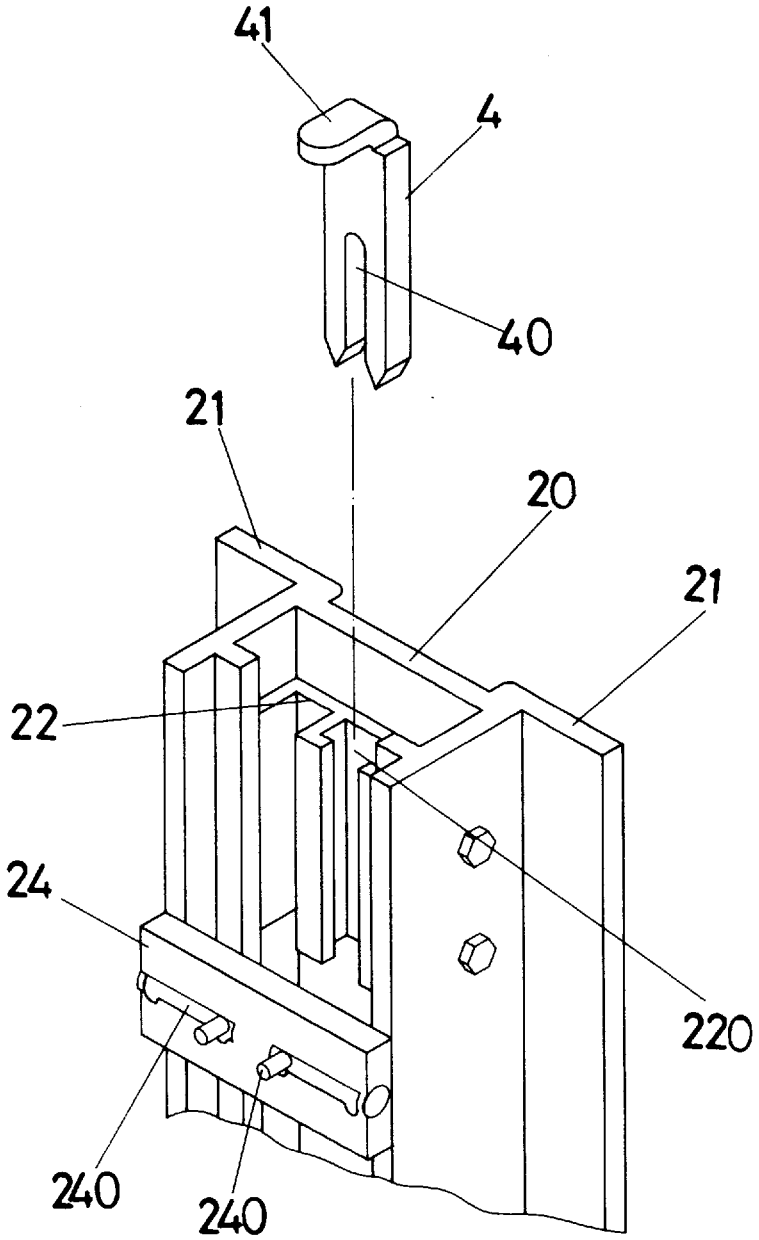
FIG. 3 is a part magnified perspective view of a securing frame in the concrete form securing device in the present invention.

A preferred embodiment of a concrete form securing device in the present invention, as shown in FIG. 2, includes two securing frames 2, 2 being oppositely located to face each other. Each securing frame 2 has a shaped frame body 20, a position side wall 21 respectively extending sidewise from two sides of a bottom of the frame body 20, and plural-shaped insert blocks 22 spaced apart equidistantly inside the frame body 20 in a lengthwise direction. Each insert block 22 has an insert lengthwise groove 220 and a bar hole 23 through the block wall and the bottom of the frame body 20. Further, the securing frame 2 has plural support boards 24 fixed spaced apart on an upper side, and each support board 24 has two pins 240 fitted in two horizontal separated slots in a line as shown in FIG. 3. In addition, a stabilizing base 25 is provided in the lower end of the securing frame 2, having screw holes 150.

Further, the concrete form securing device also includes plural spacing bars 3 having their two ends inserted in the bar holes 23 of the securing frame 2, an intermediate portion tapered to both sides, an outer rubber layer 30 wrapping around the intermediate portion, a shoulder 31 respectively provided at two sides near two flat end projections 32, 32 bored with a pin hole 33.

Further, the concrete form securing device also has plural engaging members 4 respectively fitted in the insert groove 220 of each insert block 22 and having a slot 40 engaging with a shoulder 31 of each spacing bar 3, and a bent grip 41 formed at an upper end.

In addition, the concrete form securing device also has plural horizontal fixing boards 5 positioned on the two end projections 32 of the spacing bars 3 and located outside of the securing frames 2 and the concrete forms A.

The concrete form securing device also has plural cushion members 6 respectively provided with a hole 60 for the end projection 32 of each spacing bar 3 to fit through and thereby secured, and plural flat pins 7 having one side tapered down and fitting in the pin holes 33 of the spacing bars 3 to secure the bars 3 in place.

Figure 4:
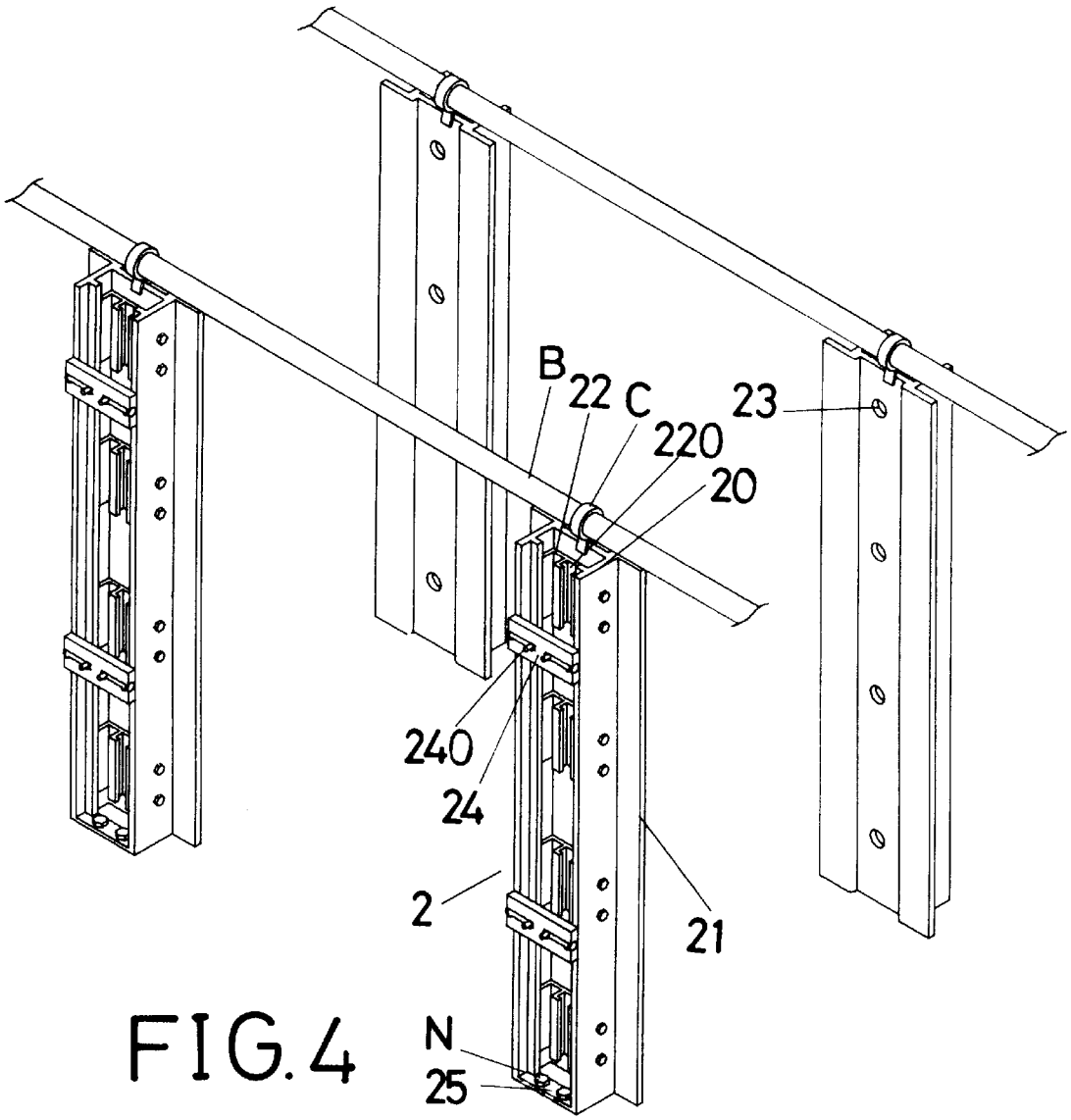
FIG. 4 is a perspective view of a sustain bar and an annular clamper combined with the concrete form securing devices in the present invention.
Figure 5:
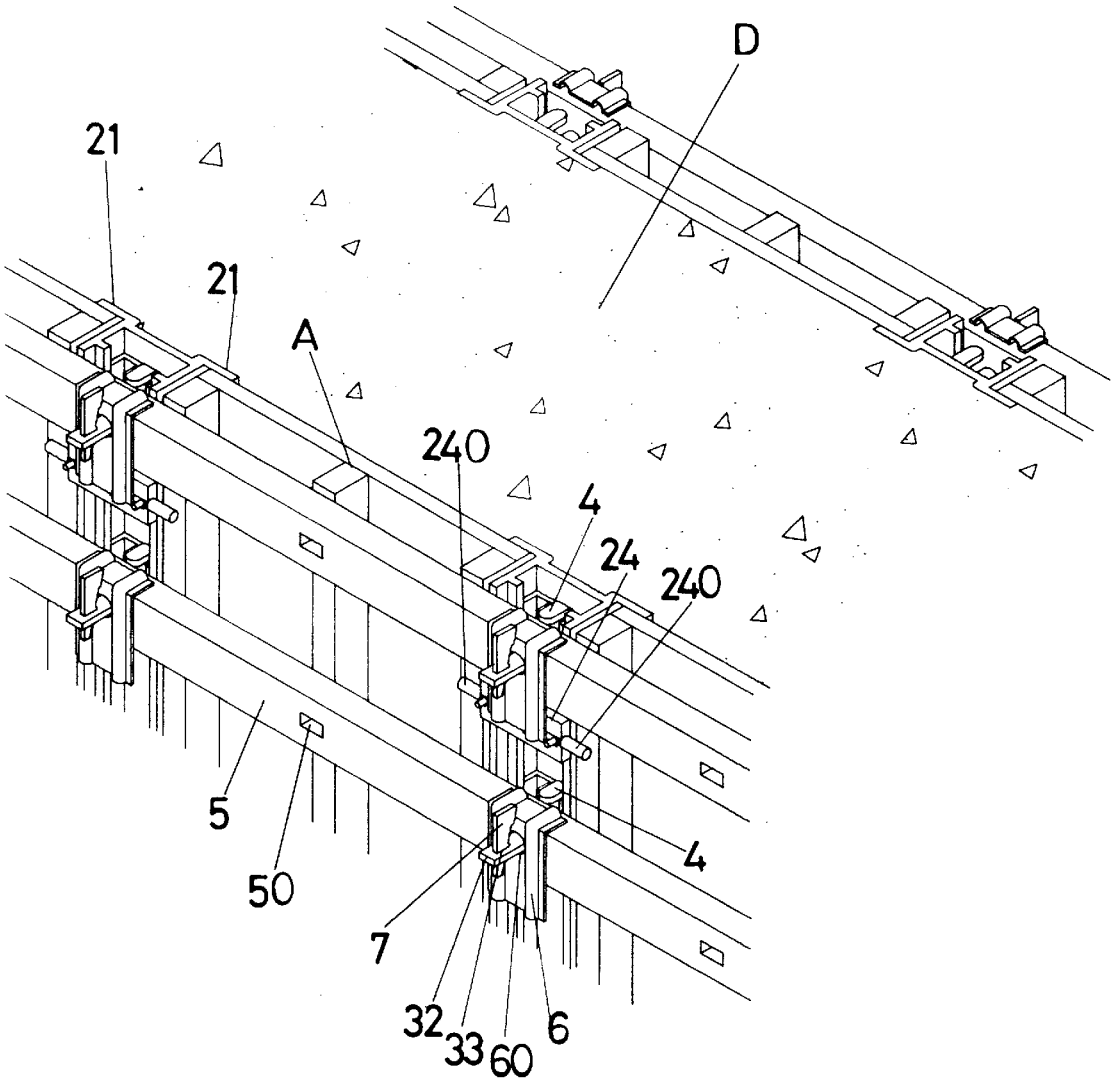
FIG. 5 is a perspective view of the concrete form securing device in the present invention, showing it in practical use.
Figure 6:
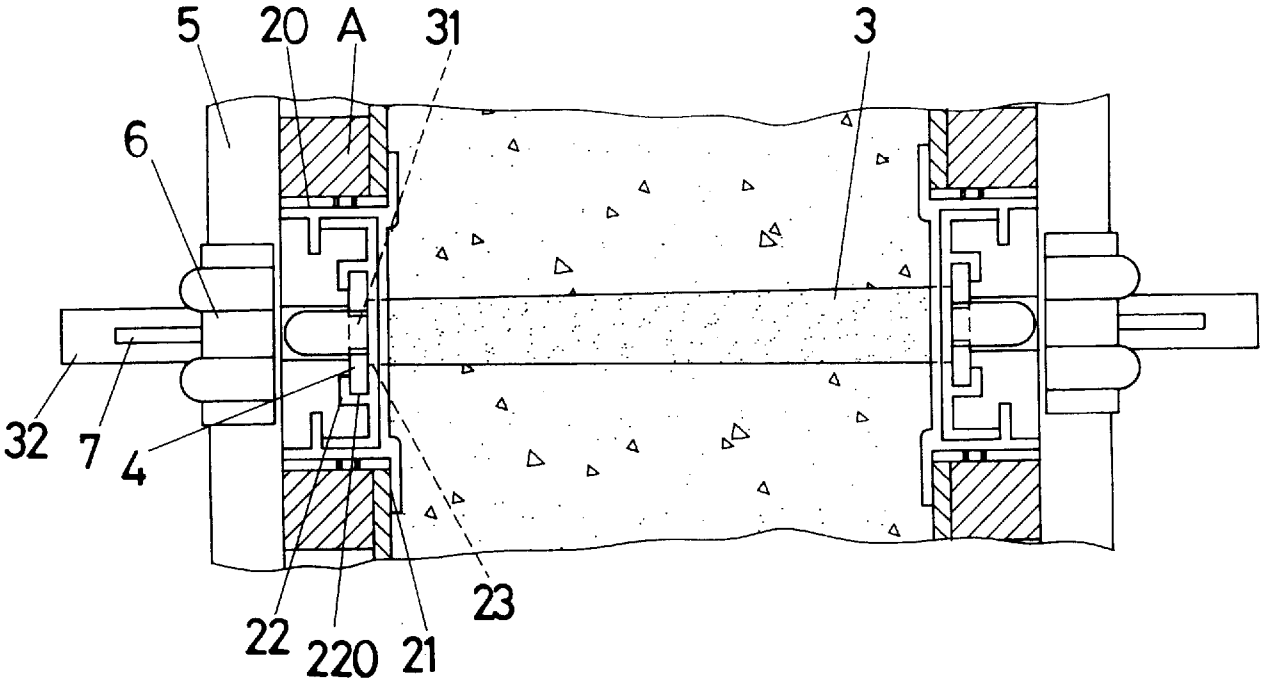
FIG. 6 is an upper view of the concrete form securing device in the present invention, showing it combined together for practical use; and, FIG. 7 is a cross-sectional view of an engaging member engaging with a shoulder of a spacing bar in the concrete form securing device in the present invention.
Figure 7:
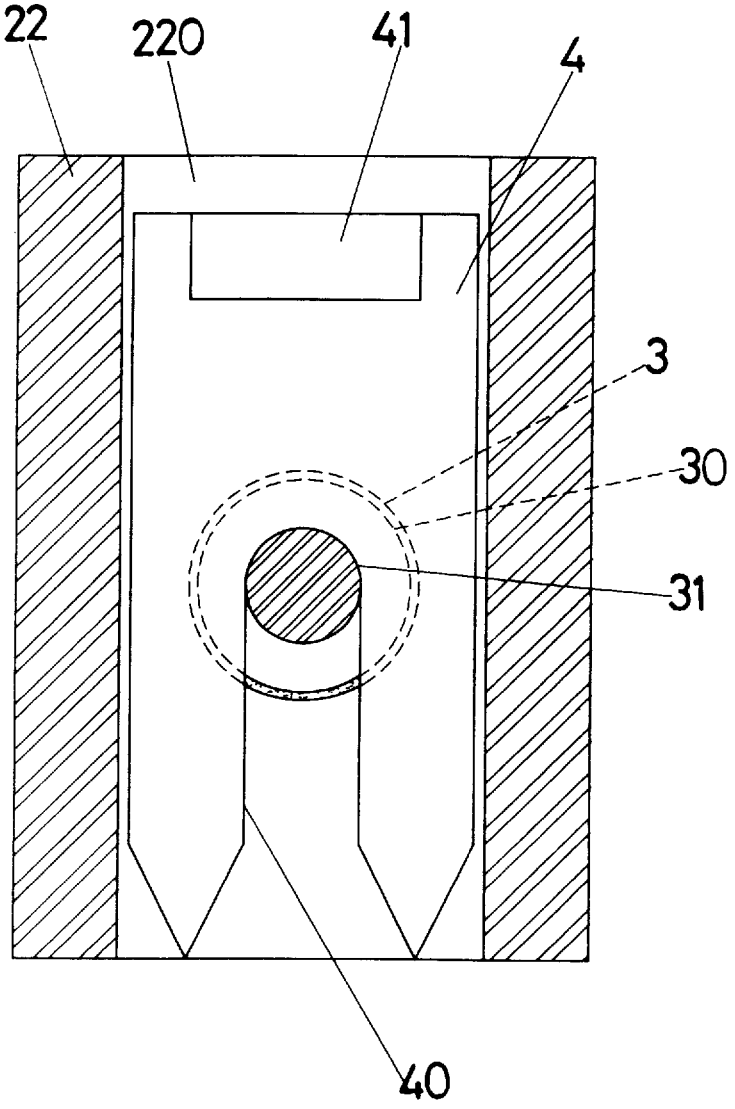

In using the concrete form securing device in the present invention, as shown in FIGS. 4 and 5, at first, two parallel sustain bars B, B are temporarily set at both sides of a would-be wall to be built, with plural annular dampers C attached with each sustain bar B. Then the upper end of each frame body 20 of the securing frames 2 is to be clamped by the annular clamper C, with the stabilizing base 25 of each securing frame 2 fixed firmly on the ground by means of screws or the like so that the securing frames 2 may not sway or move at all. After that, the two smaller end projections 32 of each spacing bar 3 should be fitted in the bar holes 23 of the securing frame 2 as shown in FIG. 6, with the shoulders 31, 31 of each spacing bar 3 engaging the insert groove 220 of the insert block 22. Then the engaging members 4 are to be inserted and pressed down in the insert groove 220 of the insert block 22, with the slot 40 engaging the shoulder 31 of the spacing bar 3, as shown in FIG. 7. Thus the two opposite securing frames 2, 2 are kept stabilized at the space of the would-be wall, and the concrete forms A are to be placed on the position side walls 21, with the pins 240 of the support board 24 pulled outward to prevent the concrete forms A from falling down. Then the pin holes 50 of the plural fixing boards 5 are to be engaged with the end projecttions 32 of the spacing bar 3, with the fixing boards 5 respectively urging the relative concrete form A. Now, the cushion members 6 are combined with the spacing bars 3, with the end projections 32 fitting through the holes 60, and the the flat pins 7 are inserted in the pin holes 33 of the spacing bar 3, stabilizing the concrete form A between the fixing boards 5 and the position side wall 21 of the securing frame 2. Before concrete D is poured in the space formed by the two rows of the concrete forms A secured by the concrete form securing device, the annular clampers C have to be removed from the upper end of the securing frame 2, and then the two sustain bars B have also to be removed.

After the concrete poured in the space between two rows of the concrete forms A hardens completely, the concrete form securing device may be taken apiece, by taking off in order the flat pins 7, the cushion members 6, the fixing boards 5, fixing members 4, etc. With the the pins 240 pushed inward, the concrete forms A can be removed quickly, and the spacing bars 3 can be pulled off the concrete wall and then off the securing frames 2, as their rubber-wrapped intermediate portions are shaped tapered to the two sides. Finally the fixing means N are loosened off the stabilizing bases 25 of the securing frames 2, permitting the frames 2 removed from the ground. The holes left by the pins 240 or rough surfaces can be filled or smoothed flat to smooth the outer surface of the wall.

Therefore, the concrete forms A used in this invention may not be impaired or harmed in building wall process and usable again and again, and in addition, needing fewer screws and time used in assembling or disassembling than the known conventional concrete form securing device does.

As can be understood from the above description, this invention has the following advantages.

1. In securing concrete forms A, no holes or screws are needed, so work can be performed more quickly and cost can be saved considerably than the known conventional ones.

2. As no nuts are used, concrete forms A can be prevented from impair and harm caused by compress of nuts against them, and thereby prolonged in service life.

While the preferred embodiment of the invention has been described above, it will be recognized and understood that various modifications may be made therein and the appended claims are intended to cover all such modifications which may fall within the spirit and scope of the invention.

What is claimed is:

1. A concrete form securing device comprising:

two or more securing frames respectively having a frame body, plural support boards releasably fixed on an outer vertical surface, and a stabilizing base fixed in a lower end, each said support board having two horizontal slots respectively opening to a right and a left side and located in a line and two pins fitted movable in said slots;

plural spacing bars having an intermediate portion tapered to both sides, two end projections respectively bored with a pin hole, said intermediate portion wrapped around with a rubber layer, said two end projections inserted through said two securing frames;

plural fixing boards respectively fixed on said end projection of each said spacing bar, located at outside of each said securing frame, respectively having plural holes spaced part equidistantly and shaped the same as said pin hole of each said end projection of said spacing bar;

plural cushion members of an inverted L-shape respectively fixed on each said end projection of said spacing bar, respectively having a hole for each said end projection to pass through;

plural flat pins respectively fitted in each said pin hole of each end projection of said spacing bar;

and characterized by said frame body having a position side wall extending sidewise from two sides of its bottom, by said frame body having plural insert blocks fitted spaced apart equidistantly in its interior, by each said insert block having an insert groove and a bar hole through itself and said securing frame, by each said spacing bar having a shoulder respectively near two ends, by plural engaging members respectively having a vertical slot opening to a lower end and fitted in each said insert groove of each said insert block, by said spacing bars respectively having their two end projections fitted through said bar holes of a pair of said two securing frames, by said engaging members inserted in said insert groove and engaging said shoulders of said spacing bars, by said concrete forms respectively rested on said position side walls of each said securing frame, by said fixing boards and said cushion members orderly and respectively fixed on said spacing bars, by said flat pins respectively inserted firmly in said pin holes of each said spacing bar so as to keep said concrete forms in place securely without using any holes bored therein or bolts and nuts passing therethrough for securing them.

2. The concrete form securing device as claimed in claim 1, wherein said frame body of said securing frame is shaped.

3. The concrete form securing device as claimed in claim 1, wherein said insert block of said securing frame is shaped.

* * * * *